US005319532A

United States Patent [19]

Pidancet

[11] Patent Number: 5,319,532

[45] Date of Patent: Jun. 7, 1994

[54] METHOD AND APPARATUS FOR ELECTRICALLY INTERCONNECTING SIGNALLING LAMPS AND SOCKETS

[75] Inventor: Jean Pidancet, Besancon, France

[73] Assignee: Socop S.A., Besancon, France

[21] Appl. No.: 798,399

[22] Filed: Nov. 26, 1991

[30] Foreign Application Priority Data

Nov. 26, 1990 [FR] France ..... 90 14909

[51] Int. Cl.[5] ..... H01R 33/09

[52] U.S. Cl. ..... 362/226; 362/83.3; 439/877; 313/318

[58] Field of Search ..... 362/23, 62, 83.3, 226, 362/369; 439/874, 875, 877, 879; 313/318

[56] References Cited

U.S. PATENT DOCUMENTS

| | | | |
|---|---|---|---|
| 2,462,867 | 3/1949 | Hubbell | 439/874 |
| 2,615,950 | 10/1952 | Lamb | 313/318 |
| 2,794,176 | 5/1957 | Barnes | 439/874 |
| 3,093,768 | 6/1963 | Ayres | 313/318 |
| 3,511,982 | 5/1970 | Salter | 362/226 |
| 3,555,341 | 1/1971 | Curtis | 313/318 |
| 3,699,328 | 10/1972 | Murray | 439/877 |
| 4,204,273 | 5/1980 | Goldberg | 362/226 |
| 4,473,770 | 9/1984 | Baba et al. | 362/226 |
| 4,999,751 | 3/1991 | Chen | 362/226 |
| 5,121,304 | 6/1992 | Hall et al. | 362/226 |

FOREIGN PATENT DOCUMENTS

| | | | |
|---|---|---|---|
| 3729622 | 1/1989 | Fed. Rep. of Germany | 362/306 |

*Primary Examiner*—Ira S. Lazarus
*Assistant Examiner*—Y. Quach
*Attorney, Agent, or Firm*—Weiser & Associates

[57] ABSTRACT

An indicator light for installation on a printed circuit board or card is provided with a miniature incandescent bulb having leads formed as conducting wires, and a bulb receptacle having metal contacts for electrical connection with the conducting wires of the incandescent bulb. The conducting wires of the bulb are connected to the metal contacts of the bulb receptacle by a crimped connection, and by a soldered connection which is separate from the crimped connection, and the conducting wires are provided with a curvature by wrapping around base portions of the metal contacts of the bulb receptacle.

5 Claims, 2 Drawing Sheets

METHOD AND APPARATUS FOR ELECTRICALLY INTERCONNECTING SIGNALLING LAMPS AND SOCKETS

BACKGROUND OF THE INVENTION

The subject of the present invention is an improvement to signalling lamps intended in particular to be mounted on circuit boards or cards and serving as pilot lights, the said lamps comprising:

- a miniature incandescent bulb with leads in the form of conducting wires,
- a bulb-receiving body including metal contacts for connecting with the power circuits, and
- means of connection between the conductors of the lamp and the metal contacts, including a crimping and a soldering connection. The subject of the present invention is also a method for manufacturing such lamps.

DESCRIPTION OF RELATED ART

Lamps of this type and their receiving body (or cap) are in themselves well known, in particular from European Patent EP 310 792.

At the level of the connection between the conductors and the electrical contacts, it is customary to produce a crimping between the wire coming from the bulb and the electrical contact of the receiving body, as well as a complementary soldering at the precise position of the crimping.

This design exhibits the disadvantage that the soldering, once effected, does not allow observation of the effectiveness of the crimping. Moreover, the soldering may itself sometimes put the crimping at risk. Thus, it has already been proposed to carry out the soldering and the crimping at separate locations as in U.S. Pat. No. 2,794,176. However, the result obtained cannot be transferred to the specific field of signalling lamps since there is a risk of wire breakage.

SUMMARY OF THE INVENTION

It is therefore the principal object of the present invention to provide an electrical connection for signalling lamps of the type previously discussed which alleviates the above-noted disadvantages.

According to the invention, to this end an improvement is proposed to signalling lamps intended in particular to be mounted on circuit boards or cards for serving as pilot lights, the said lamps comprising:

- a miniature incandescent bulb with leads in the form of conducting wires,
- a bulb-receiving body including metal contacts for connecting with the power circuits, and
- means of connection between the conductors and the metal contacts, including a crimping and a soldering connection, characterised in that the crimping and the soldering are done at different locations, and wherein a curvature is applied to the wires at the base of their crimping onto the contact.

It is thus possible to observe the effectiveness of each of the operations.

Also, according to the invention, a general method is provided for effecting, on lamps of this type, a soldering and a crimping connection at distinct locations.

BRIEF DESCRIPTION OF THE DRAWINGS

The invention will be better understood with the aid of the following description of a preferred mode of implementation, given by way of non-limiting example, with reference to the attached drawings in which.

DETAILED DESCRIPTION OF THE INVENTION

Figure 1:
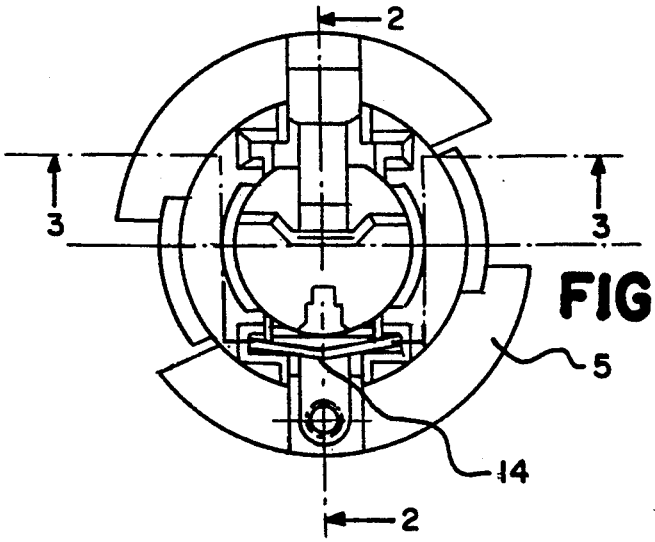
FIG. 1 is a view from above of a bulb and its holder.
Figure 2:
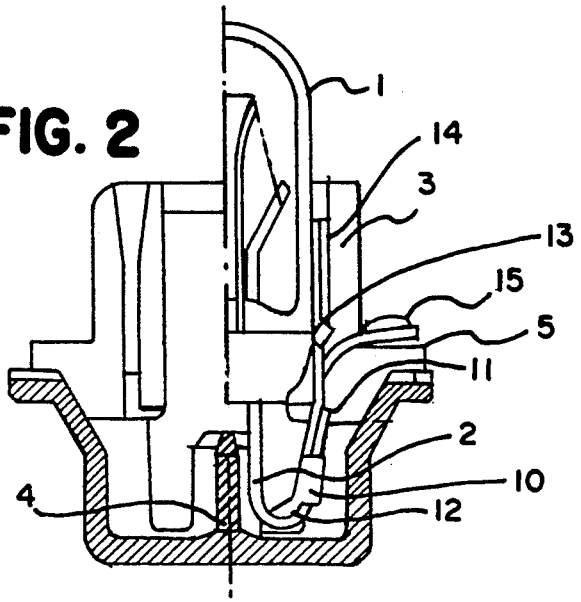
FIG. 2 is a section along 2—2 of FIG. 1.
Figure 3:
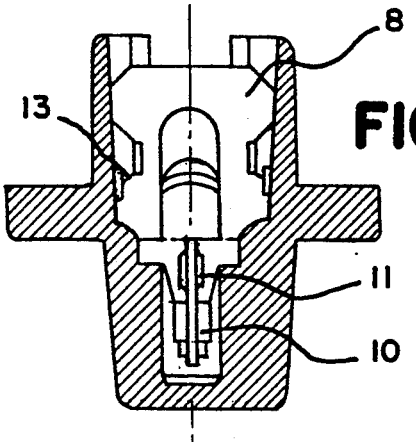
FIG. 3 is a section along 3—3 of FIG. 1.
Figure 4:
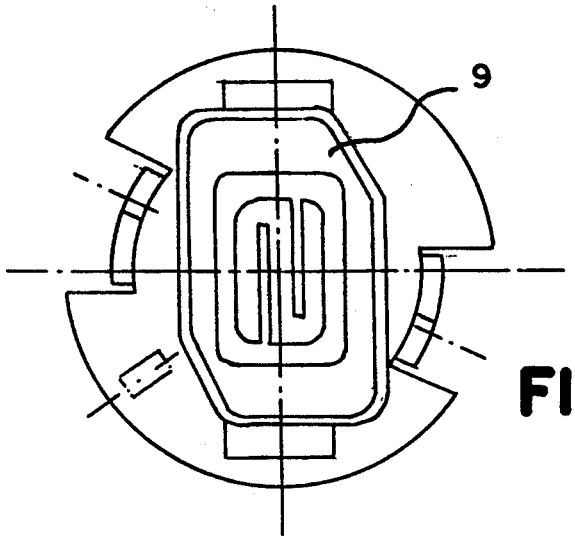
FIG. 4 is a view from below the bulb holder.
Figure 5:
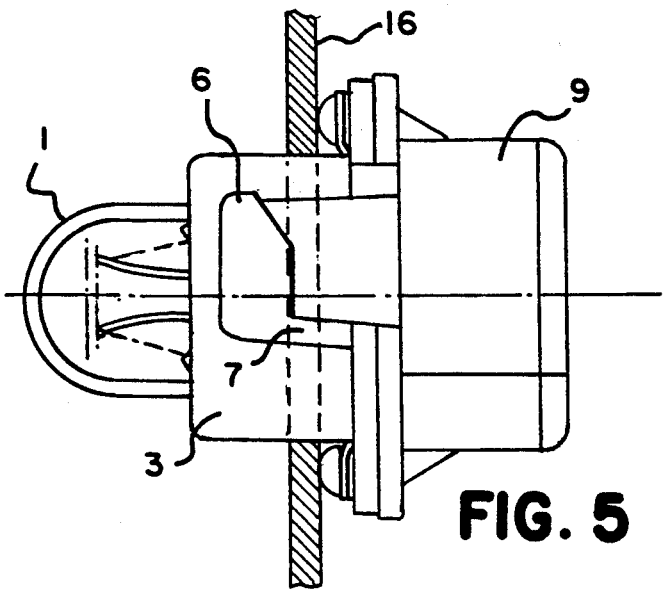
FIG. 5 is a side-elevational view of the lamp of FIG. 1, at the position of the locking pins.
Figure 6:
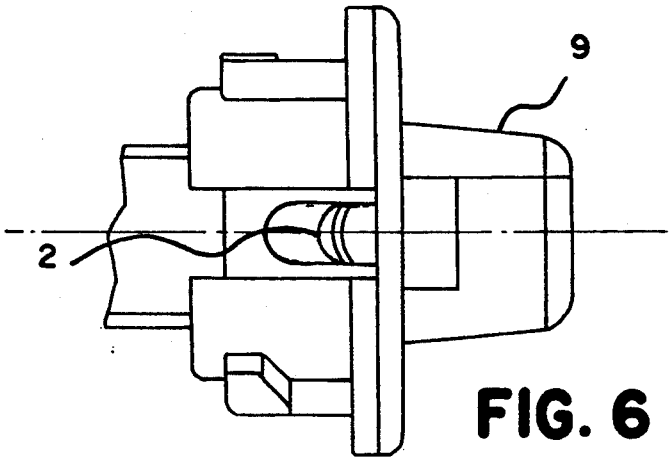
FIG. 6 is a side-elevational view, and also showing a cross-sectional view of a printed circuit board of the lamp of FIG. 1, at the position of the external electrical contacts of the holder.

The lamp according to the invention is intended in particular, but not limitingly, for signalling application by mounting on printed circuit boards, cards with lamps, or in order to serve as pilot lights.

It includes a miniature incandescent lamp bulb with wire leads and a luminescent body (1) which is housed in position without being subjected to retaining stresses (possibly arising from the metal contacts or from the plastic body).

Conductors (2) serve to convey the current, and hold the luminescent body (1) and retain it in position (possibly while being set into an adhesive). The conductors (2) exit at the base of the bulb.

It also includes a body (3) made of plastic material with a means of receiving the bulb (a housing chamfered at the inlet allowing penetration and installation of the bulb without tightening).

A rib (4) at the bottom of the body (3) allows clear separation of the two wire leads from the bulb, thus avoiding the risk of short-circuits.

A circular collar (5) makes it possible to abut on a printed circuit board (16) when fitting the lamp holder.

Two diametrically opposed pins (6) make it possible, once rotated against the abutments (7) has been effected, to retain the holder in position on the printed circuit board (16), by virtue of the retaining force applied by the contacts (8).

An ergonomically shaped base (9) facilitates manual mounting of the assembly on the printed circuit board as well as the choice of automatic mounting.

Electrical contacts (8) made of a metallic and elastic material are aligned axially and inserted into housings provided for this purpose in the body (3).

This allows electrical connection between the printed circuit board (16) and the wire leads of the bulb. According to the invention, each of the contacts (8) is fixed, for this reason, to one of the wire leads by a crimping (10) followed by a soldering (11) which are effected in such a way that are offset relative to one another. This avoids any undesirable interaction between the two operations.

A curvature (12) is formed at the base of the contact (8) so as to avoid any risk of breaking the wire leads on the contacts in this location owing to this curvature.

The contacts (8) are retained inside the plastic body by two different elements: - a pair of retaining pins (13) allowing the contacts (8) to be engaged in the body (3) and preventing them from coming out by virtue of the orientation of their bending, and a resin which, if desired, is injected at the bottom on the holder through an orifice (which can be provided on the bottom of the latter) after inserting the bulb with its contacts into the body, or which in the alternative is injected from above the holder before inserting the bulb with its contacts, in either case to satisfy potential specifications regarding resistance to extraction forces applied to the bulb.

A vertical bend (14) is effected on the contact (8) in order to avoid contact with the glass of the bulb, and therefore the stresses possibly resulting therefrom.

An elastic spar (15) culminating in a spherical pressing gives the contact (8) pressure against the printed circuit board where the lamp is to be arranged in order to ensure electrical connection between the two.

I claim:

1. An indictor light for installation on a circuit board, comprising:

a miniature incandescent bulb having leads formed as conducting wires;

a bulb receptacle having metal contacts for electrical connection with the leads of the incandescent bulb;

means for connecting the conducting wires and the metal contacts including a crimped connection and a soldered connection wherein the crimped connection and the soldered connected are at different locations; and a curvature formed at a base end of each contact, in an area below the connecting means, for receiving the conducting wire as the conducting wire wraps around the curvature of the metal contact.

2. The indicator light of claim 1 wherein the curvature of the metal contact receives the conducting wire at a location between the incandescent bulb and the connecting means, for supporting the received conducting wires.

3. The indicator light of claim 1 wherein the curvature of each metal contact is formed at a location separate from portions of the metal contact which include the crimped connection and the soldered connection.

4. A method for assembling an indicator light for installation on a circuit board, said indicator light including an incandescent bulb having leads formed as conducting wires and a bulb receptacle having metal contacts for electrical connection with the leads of the incandescent bulb, and said method comprising the steps of:

connecting the conducting wires of the incandescent bulb and the metal contacts of the bulb receptacle by crimping portions of the metal contacts to portions of the conducting wires at a first location and soldering portions of the metal contacts to portions of the conducting wires at a second location different from the first location; and providing each conducting wire with a curvature and wrapping the conducting wire around a curvature, of the metal contact, formed at a base end of the metal contact in an area below the connection with the conducting wire.

5. An indicator light for installation on a circuit board, comprising:

a miniature incandescent bulb having leads formed as conducting wires;

a bulb receptacle having metal contacts for electrical connection with the leads of the incandescent bulb;

means for connecting the conducting wires and the metal contacts including a crimped connection and a soldered connection, wherein the crimped connection and the soldered connection are at different locations; and a curvature formed at a base end of each metal contact in an area below the connecting means for receiving the conducting wire, wherein the conducting wires wrap around the curvatures of the metal contacts at a location between the incandescent bulb and the connecting means, for supporting the conducting wires.

* * * * *